US005333630A

United States Patent [19]

Jepsen et al.

[11] Patent Number: 5,333,630

[45] Date of Patent: Aug. 2, 1994

[54] APPARATUS FOR THE CLEANING OF A CLOSED COMPARTMENT

[75] Inventors: Erik L. Jepsen, Bringekrogen; Jørgen F. Nielsen, Pinjevangen, both of Denmark

[73] Assignee: Toftejorg A/S, Ishoj, Denmark

[21] Appl. No.: 30,212

[22] PCT Filed: Sep. 20, 1991

[86] PCT No.: PCT/DK91/00284

§ 371 Date: Mar. 12, 1993

§ 102(e) Date: Mar. 12, 1993

[87] PCT Pub. No.: WO92/04994

PCT Pub. Date: Apr. 2, 1992

[30] Foreign Application Priority Data

Sep. 20, 1990 [DK] Denmark ..... 2274/90

[51] Int. Cl.[5] ..... B01B 3/02

[52] U.S. Cl. ..... 134/104.1; 134/167 R; 134/177; 134/169 R

[58] Field of Search ..... 134/104.1, 141, 166 R, 134/167 R, 168 R, 169 R, 170, 180, 176, 177; 239/227, 240

[56] References Cited

U.S. PATENT DOCUMENTS

| | | | |
|---|---|---|---|
| 2,917,243 | 12/1959 | Lione | 134/167 R X |
| 3,255,969 | 6/1966 | Saad | 239/240 |
| 3,326,468 | 6/1967 | Bristow et al. | 239/240 |
| 3,384,907 | 5/1968 | Lappin et al. | 134/167 R |
| 3,544,012 | 12/1970 | McNally | 239/240 |
| 3,902,670 | 9/1975 | Koller | 239/240 |
| 4,244,524 | 1/1981 | Wellings | 134/167 R |
| 4,347,979 | 9/1982 | Mathews . | |

*Primary Examiner*—Frankie L. Stinson
*Attorney, Agent, or Firm*—McAulay Fisher Nissen Goldberg & Kiel

[57] ABSTRACT

A compact cleaning plant is provided which has great cleaning effect and is self-cleaning. The apparatus according to the invention has a conical stationary part (1) mounted on the inlet pipe for the cleaning liquid, and on which there is suspended a 90° pipe bend (16), the end of which has a hub (11) with nozzles (12) mounted in a rotatable manner in relation to the pipe bend. In this housing, there is contained a turbine (23) which drives a planet gear (15, 27) for turning the pipe bend (16), while at the same time the hub (11) is turned by means of toothed rims (8, 13) enclosed within the housing (1, 16, 11). The housing is also provided with outlet openings (35) and outlet slots (36, 37) for that part of the liquid (39) which serves to lubricate and clean the bearings, said openings and slots being positioned and configured in such a manner that the diverted out-flowing liquid also sweeps all of the housing's external parts. The apparatus is thereby held clean both internally and externally during cleaning, which is of decisive importance where great demands regarding hygiene have to be met, while at the same time it is ensured that all movable parts of the apparatus are kept clean and functionally efficient. Finally, the liquid flows evenly through the apparatus, whereby the loss of pressure is very low.

10 Claims, 3 Drawing Sheets

APPARATUS FOR THE CLEANING OF A CLOSED COMPARTMENT

BACKGROUND OF THE INVENTION

The invention relates to apparatus for the cleaning of closed compartments by means of sprayed-out liquid, and comprising a housing with a stationary part to which the liquid is supplied, and on which there is mounted a rotatable part having a hub with spray nozzles suspended in bearings therein. A turbine driven by the liquid and having a planet gear mounted in the stationary part is provide for turning the rotatable part and the nozzles in such a manner that the liquid sprayed out through the nozzles during rotation can sweep the whole of the interior of the compartment.

Apparatus of this kind is used especially for the internal cleaning of tanks within the foodstuffs industry, the chemical and pharmaceutical industries and similar industries where tanks must be kept clean.

Cleaning is effected by means of liquid supplied under pressure to the apparatus through a pipe, after which it is sprayed out through nozzles which rotate around a horizontal axis as well as around a vertical axis, so that after a certain number of revolutions the apparatus will have cleaned the whole of the inside tank.

Previously known apparatus for this purpose comprised a housing in which there was mounted a turbine in the liquid flow, so that a gear can be coupled to and in extension of the turbine axle. The gear can turn a part of the housing around a vertical axis in relation to the remaining fixed part of the housing, to which is fastened a supply pipe for the liquid.

Mounted radially on the rotatable part of the housing there is a hub on which the nozzles are mounted, in that said nozzles rotate around their horizontal axes by means of a gear exchange. This apparatus is thus driven by the cleaning liquid, in that pressure from the main flow drives the turbine, after which the liquid is led out through an opening in the bottom of the housing. The main flow is deflected in the housing at right-angles and is fed through the hub and out through the nozzles.

However, this construction is encumbered with drawbacks and disadvantages.

First and foremost, there is a considerable loss of energy in the flow of liquid through the apparatus, due particularly to the sharp deflection of the liquid flow.

To this must be added that the apparatus is developed to work only in the vertical position. This limits the use of the apparatus to tanks, where there is access from the top. Finally, there is a risk of the housing becoming sullied both internally and externally by the contents of the tank, and thus the apparatus is unable to function because of the inability to rotate. Similarly, there can be a risk of pollution of the contents of the tank.

In order to overcome these drawbacks, it is known from EP publication no. 0,004,954 to build a turbine into the actual main flow in the apparatus, said turbine being used via a planetary gear to turn both a rotatable part of the housings and a hub with the nozzles, while at the same time the liquid is sprayed out to soften and clean the inside of the tank.

The drive for turning the hub is configured as a conical gear which extends externally on the housing and which is therefore free-lying in the tank. Moreover, the parts are suspended in ball bearings, all of which are contained in totally or partially closed bearing housings.

The result of this construction is that the apparatus has a relatively poor efficiency, especially in strongly polluted environments where the gears easily get sullied, whereby their friction becomes great. In worst case, this can be so high that rotation ceases completely because of the blockage. Furthermore, the mounting of the bearings can give rise to operational problems, in that they are difficult to lubricate and keep clean because of the totally or partially closed mounting. This results in poor lubrication with high friction and consequently, a short lifetime for the bearings.

In addition, the outside of the housing easily becomes' dirty, in that the housing cannot avoid being sullied with the tank contents, with the risk that this infiltrates into the housing through drain holes and nozzles. This gives rise to a considerable risk of pollution of the tank contents, and requires a subsequent cleaning both internally as well as externally. Consequently, this means that the apparatus must be cleaned, which is both troublesome and time-consuming.

ADVANTAGES OF THE INVENTION

By configuring the apparatus according to the invention in such that the gear's planet wheel is externally in engagement with a toothed rim mounted on the stationary part of the housing, said toothed rim being in engagement with a toothed rim on the hub, both toothed rims being surrounded by the housing, the advantage achieved first and foremost is that the apparatus can be of a very compact construction.

This is due to the internal positioning of the toothed rims, which allows the planetary gear to extend into the toothed rim on the stationary part. Moreover, this compact construction offers the further advantage that the apparatus becomes more stable, and the possibility is provided of suspending the turbine axle in a lower bearing.

To this is added the advantage that the teeth can be rinsed through by the liquid, and thereby kept lubricated and clean. The friction is considerably reduced, which not only ensures smooth operation and a long lifetime for the apparatus, but also a high degree of hygiene since the apparatus is kept clean internally by the liquid. This is achieved without exposing the pressure liquid to any loss of pressure through the apparatus.

By leading the liquid flow through the gear, the toothed rims and the bearings, and by discharging this liquid through outlet slots along adjacent end surfaces at the rotatable parts, an effective cooling, lubrication and cleaning of these parts is ensured, and also security for a high degree of hygiene and long lifetime.

By further configuring a number of outlet openings in the bottom of external recesses in the housing, it will not be possible for polluted material to be deposited in these recesses.

By configuring slots and openings in such a manner that the liquid flowing out will sweep the outside of the housing, the surface will automatically be cleaned during operation of the apparatus.

Finally, it will be expedient to provide the hub with a shield which partly covers the outlet slot, in that this will result in a strong stream of liquid being thrown back over the rotatable part, which is thus kept effectively clean.

THE DRAWING

In the following, an example embodiment of the invention will be described in more detail with reference to the drawing, where FIG. 1 shows an apparatus during operation seen from the outside with indications of the outflowing liquid streams, FIG. 2 shows a section through the apparatus, and FIG. 3 shows the course of the flow through the apparatus seen in section.

DESCRIPTION OF THE PREFERRED EMBODIMENT

Figure 1:
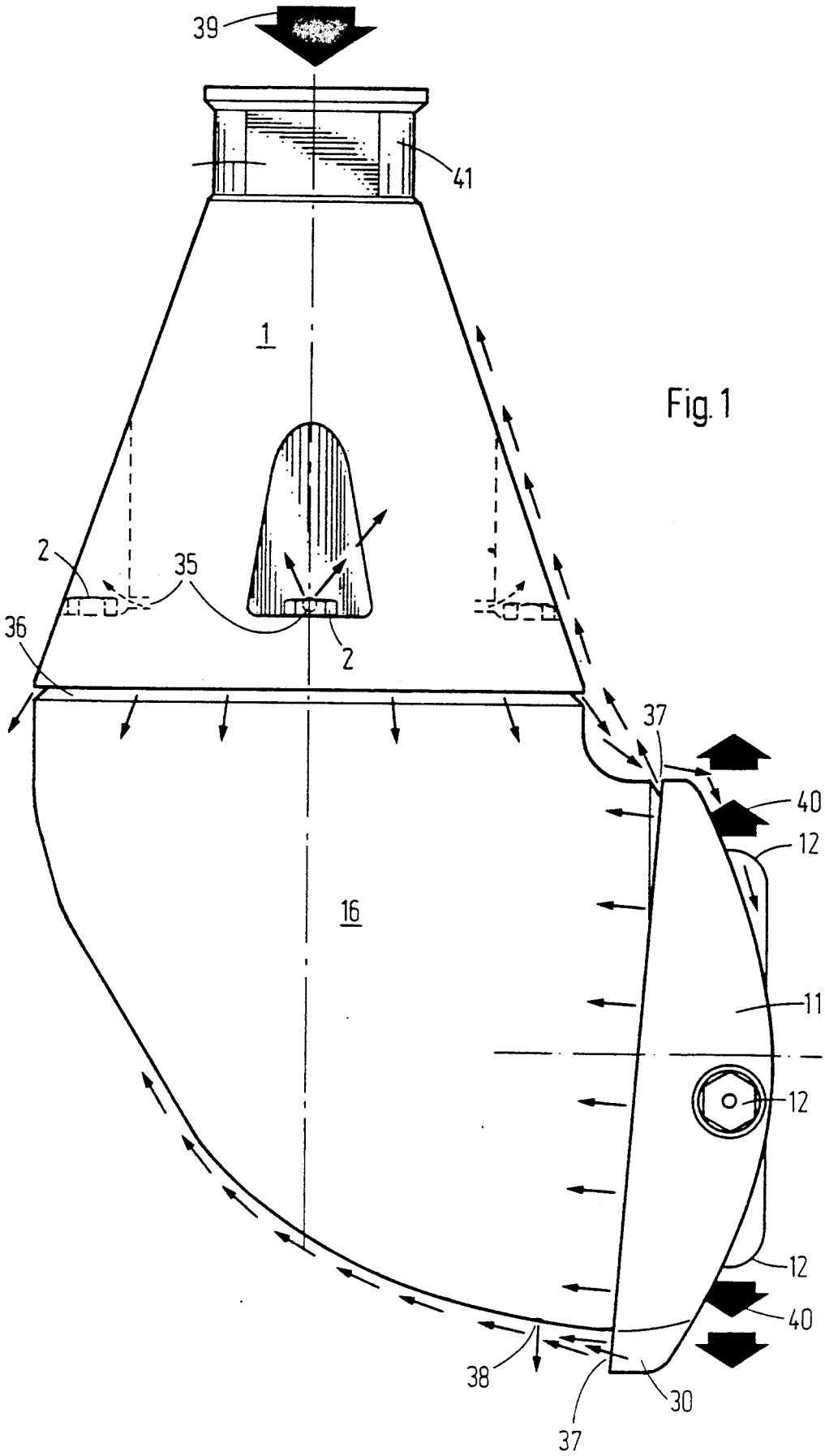

In the drawing is shown an example of a preferred embodiment of the invention.

The apparatus is built into a housing which comprises a stationary part 1 and a rotatable part 16 in the form of a pipe bend, and a hub 11 on which the nozzles 12 are mounted.

The stationary part 1 of the housing is configured as a truncated cone with a mounting stub 41 at the narrow end at the top.

The stub 41 has a thread in which a not-shown supply pipe for the inlet liquid 39 can be mounted to the apparatus. In addition to its function as a supply pipe, the supply pipe also serves to support the apparatus. It can be either a rigid pipe or a flexible hose.

Figure 2:
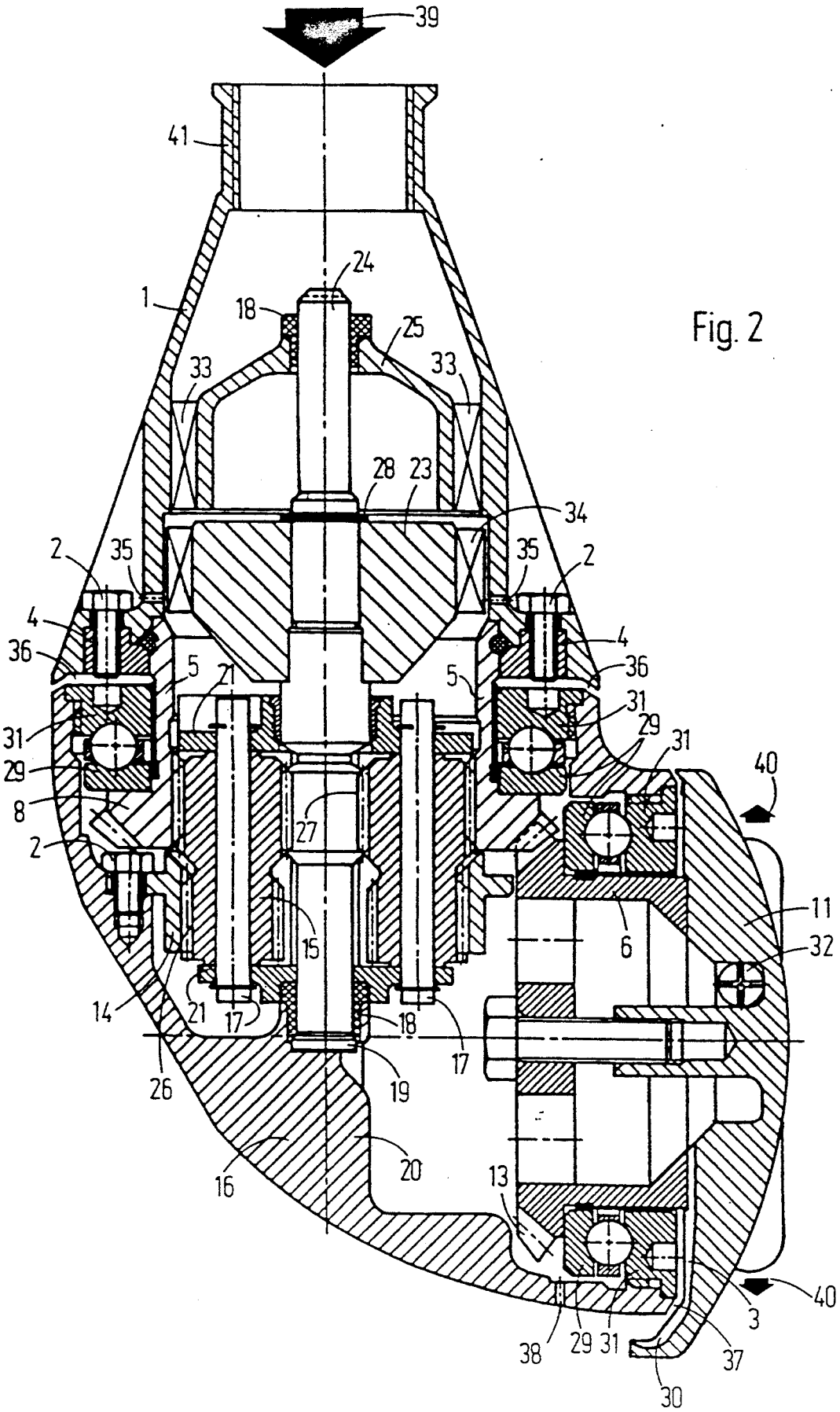

Externally, the housing 1 has a number of recesses for assembly bolts 2, which are screwed into a ring 4 with a support piece 5 for a bearing ring 29 and a toothed rim 8, see especially FIG. 2. The pipe bend 16 can thereby be suspended on the stationary part 1, in that the second bearing ring 31 is secured to the rotatable part 16.

Inside the housing 1 and along its centerline, an axle 24 is mounted in a bearing bush 18 at the top, said bearing bush 18 being supported by a cone 25 having guide blades 33 along the edge, which are secured to the housing 1.

The axle 24 under the cone 25 is provided with a locking ring 28 for securing a rotor 23. Along the edge of the rotor 23 there are provided a number of rotor vanes 34, so that via the guide blades 33 the liquid 39 can make the rotor 23 rotate, and thus constitute the turbine which imparts movement to the moving parts of the apparatus, whereby the apparatus is driven by the medium.

These parts comprise an extension of the axle, which at the bottom is housed in a bush 18 resting against a bearing disk 19 in a bearing foot 20, which extends up from this part of the housing 16 which is formed as a 90° pipe bend.

It will be seen clearly in the drawing that the axle 24 extends along the centerline of the housing 1 and along the centerline of the inlet part's pipe bend 16.

On the lower section of the axle there is secured a pinion 27 which is in engagement with a pair of planet gears 15 which are mounted on axles 17 secured in a holder 21. The planet gears 15 are in engagement externally with an internal tooth gearing in the toothed rim 8, which is secured to the housing's stationary part 1 as earlier described.

On the lower part of the planet gears 15 there are provided output gears 26 which are in external engagement with an internal toothed rim 14 secured to this part of the housing 16.

The exchange ratio between the planet gears 15, 26 and the toothed rims 8, 14 is different, so that when the turbine is turned via the planet gear, there will arise a turning movement of the housing 16 in relation to the stationary part 1.

In the opposite end of the pipe bend 16 there is suspended a hub 11 in a bearing 29, 31, the one bearing ring 31 of which is secured in the housing 16, while the other bearing ring 29 is secured to the hub 11 via an internal ring 6 with a hub which is bolted to the hub 11 on which the nozzles 12 are mounted. The ring is provided externally with a conical gear 13, this being in engagement with the external conical teeth on the toothed rim 8 which is secured to the stationary part of the housing 1. When the pipe bend 16 is turned, the hub 11 with the nozzles 12 will thus be rotated around the centerline at right-angles to the turbine's centerline for the outlet part of the pipe bend 16.

Behind the heads of the bolts 2 in the stationary part 1 of the housing there are also configured some through holes 35, and outlet slots are configured between the moving parts of the apparatus, in that there is a slot 36 between the housing's stationary part 1 and the movable part 16, and a slot 37 between the movable part 16 and the hub 11.

Furthermore, there is a drain hole 38 in the bottom of the pipe bend 16 for the evacuation of liquid from the housing after the apparatus has been used.

The flow conditions in and around the apparatus will now be described, especially with reference to FIGS. 1 and 3.

The supply liquid 39, which is also the cleaning liquid, can be any suitable solution for the softening and cleaning of the tank compartment. As an example, the liquid can have a pressure of around 8 bar and a capacity of around 10 $m^3/h$. An adequately effective cleaning can thereby be carried out up to a diameter of around 6–8 m.

The liquid 39 is fed to the turbine's rotor 23 in the center of the flow. A small amount of liquid is led out through the openings 35 in the bottom of the swages which are in this part of the housing. The space behind the bolt heads and the countersunk external housing surfaces are thus held clean, and the liquid will also hold the bolt heads clean externally.

The liquid continues from the rotor down through the pipe bend 16 through the planet gear and the drive, which are thereby lubricated and cleaned, in that a smaller part of the liquid runs through the two bearings 29, 31 and out through the horizontal slot 36 and the vertical slot 37 respectively, which are thereby lubricated and flushed clean.

Figure 3:
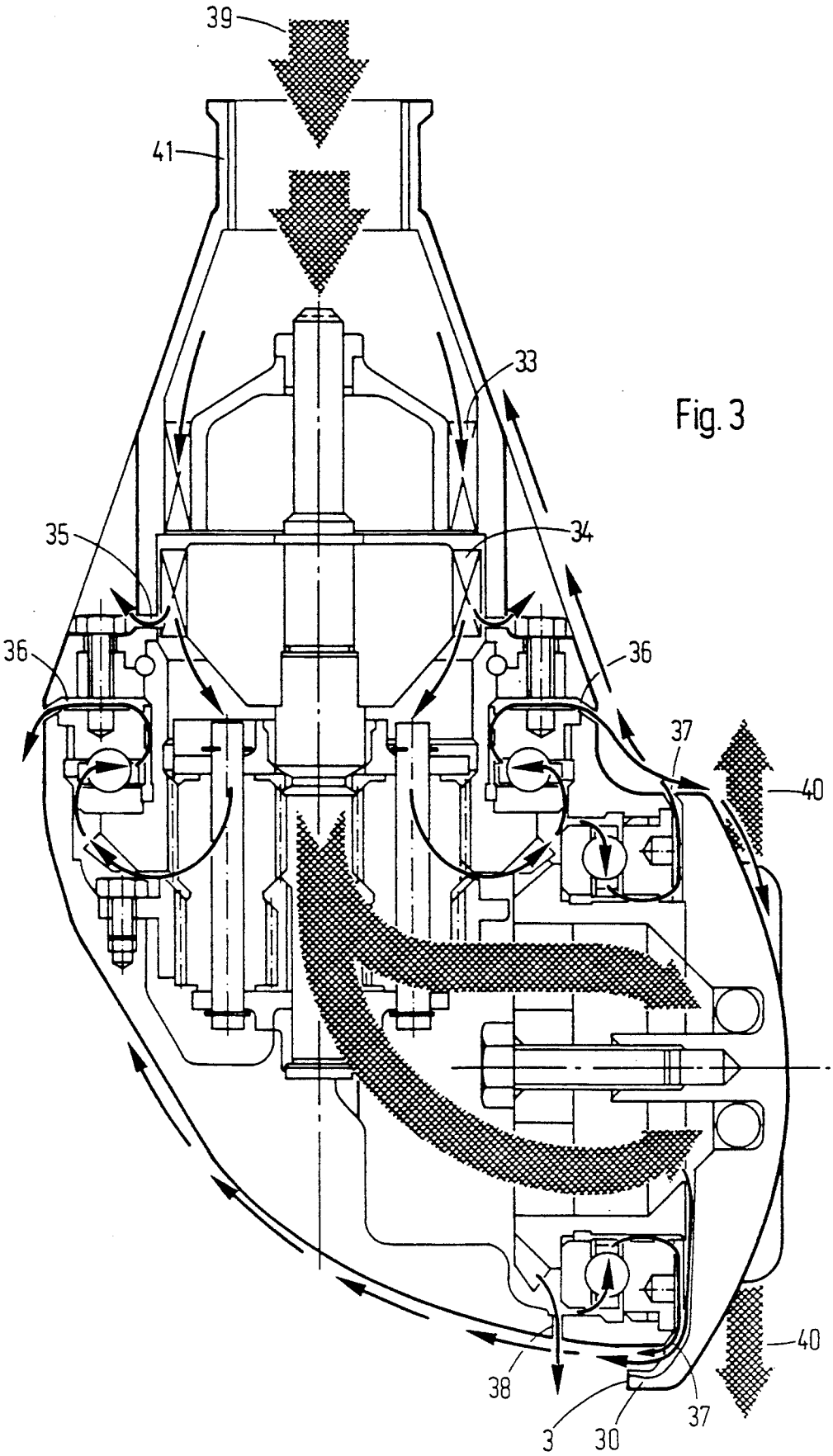

The main flow continues in an even arc, see FIG. 3, towards the nozzles 12 via liquid guides 32, see FIG. 2, to the nozzles 12. In the example shown, four nozzles are mounted for spraying liquid 40, which constitutes the tank-cleaning part of the liquid flow. There can, however, be mounted a larger or a smaller number of nozzles depending on the desired cleaning program.

In order to utilize the liquid flowing out through the openings 35 and the slots 36 for an effective external cleaning of the apparatus and the supply pipe, the hub 11 is configured with a shield 30, see FIG. 2, to which liquid is led, e.g. via a channel 3 in the hub 11, and by such an orientation of the slots that the liquid is emitted in a certain direction whereby it is able to sweep both the pipe bend 16 as well as the stationary part 1 and the supply pipe during operation, and the hub 11 can similarly be held clean.

The hub 11 will thus be cleaned by the flow of liquid which occurs via the slot 36, so that the apparatus as a whole is held clean even in strongly polluted environments.

This ensures that the apparatus can always function, since the moving parts are clean, and that the demands regarding hygiene are fulfilled, the reason being that the whole of the apparatus is clean both internally and externally.

The whole of the apparatus can be made of stainless steel and synthetic materials, whereby the apparatus will be able to fulfil the highest demands made on equipment for use in connection with foodstuffs and processes.

Moreover, the pressure loss through the apparatus is very small, the reason being that the main flow runs in an even and unbroken arc, while the two diverted cleaning flows are used for both external and internal cleaning.

We claim:

1. Apparatus for cleaning a closed compartment by means of a sprayed liquid, comprising a housing having a stationary part to which the liquid is supplied, a rotatable part mounted thereon having a hub with spray nozzles suspended in bearings therein, a turbine driven by the liquid and having a planet gear mounted in the stationary part for turning the rotatable part and the nozzles in such a manner that the liquid sprayed out through the nozzles during the rotation sweeps the closed compartment interior, the planet gear being externally in engagement with a first toothed rim mounted on the stationary part of the housing, the first toothed rim being in engagement with a second toothed rim on the hub, both toothed rims being surrounded by the housing, both toothed rims and the bearings therebetween extending into a part of the liquid flow, and, slots provided between the stationary part and the rotatable part, and between the rotatable part and the hub such that after passing through the apparatus, a portion of the liquid is led out through the slots.

2. The apparatus of claim 1, wherein the stationary part has outlet openings, the openings being placed in a bottom of one or more external recesses.

3. The apparatus of claim 2 wherein the slots and outlet openings are oriented in such a manner that the outflowing liquid sweeps the external surfaces of the housing.

4. The apparatus according to claim 1, wherein the slots are oriented in such a manner that the outflowing liquid sweeps the external surfaces of the housing.

5. The apparatus according to claim 1, further comprising a shield provided on the hub which screens a part of the slot between the rotatable part and the hub and deflects the liquid flowing out from the slot against the shield so that it sweeps the external surfaces of the housing.

6. Apparatus for cleaning a closed compartment by means of a sprayed liquid, comprising a housing having a stationary part to which the liquid is supplied, a rotatable part mounted thereon having a hub with spray nozzles suspended in bearings therein, a turbine driven by the liquid and having a planet gear mounted in the stationary part for turning the rotatable part and the nozzles in such a manner that the liquid sprayed out through the nozzles during the rotation sweeps the closed compartment interior, the planet gear being externally in engagement with a first toothed rim mounted on the stationary part of the housing, the first toothed rim being in engagement with a second toothed rim on the hub, both toothed rims being surrounded by the housing, the stationary part having outlet openings for liquid, the openings being placed in a bottom of one or more external recesses.

7. The apparatus of claim 6 wherein both toothed rims and the bearings therebetween extend into a part of the liquid flow, and further comprising slots provided between the stationary part and the rotatable part and between the rotatable part and the hub, such that after passing through the apparatus, a portion of the liquid is led out through the slots.

8. The apparatus according to claim 7, wherein the slots and outlet openings are oriented in such a manner that the outflowing liquid sweeps the external surfaces of the housing.

9. The apparatus according to claim 7, further comprising a shield provided on the hub which screens a part of the slot between the rotatable part and the hub and deflects the liquid flowing out from the slot against the shield so that it sweeps the external surfaces of the housing.

10. The apparatus according to claim 6, wherein the slots are oriented in such a manner that the outflowing liquid sweeps the external surfaces of the housing.

* * * * *